US009146010B2

(12) United States Patent
Santiago

(10) Patent No.: US 9,146,010 B2
(45) Date of Patent: Sep. 29, 2015

(54) ORNAMENT WITH BACKLIT FILM IMAGE

(76) Inventor: Robert L. Santiago, Hilo, HI (US)

( * ) Notice: Subject to any disclaimer, the term of this patent is extended or adjusted under 35 U.S.C. 154(b) by 314 days.

(21) Appl. No.: 13/248,646

(22) Filed: Sep. 29, 2011

(65) Prior Publication Data

US 2012/0081905 A1 Apr. 5, 2012

Related U.S. Application Data

(60) Provisional application No. 61/388,897, filed on Oct. 1, 2010, provisional application No. 61/393,227, filed on Oct. 14, 2010.

(51) Int. Cl.

| | |
|---|---|
| ***G09F 13/04*** | (2006.01) |
| ***F21V 29/00*** | (2015.01) |
| ***F21V 7/10*** | (2006.01) |
| ***F21V 1/22*** | (2006.01) |
| ***F21S 4/00*** | (2006.01) |
| ***F21V 29/505*** | (2015.01) |
| *F21V 7/04* | (2006.01) |

(52) U.S. Cl.

CPC . *F21S 4/001* (2013.01); *F21V 1/22* (2013.01); *F21V 29/505* (2015.01); *G09F 13/0413* (2013.01); *F21V 7/045* (2013.01); *G09F 2013/0481* (2013.01)

(58) Field of Classification Search

CPC ..... G09F 11/02; G09F 11/025; G09F 11/23; G09F 13/04; G09F 13/0404; G09F 13/0409; G09F 13/0413; G09F 7/22; G09F 15/081; G09F 2013/0481; F21V 1/22; F21V 3/02; F21V 3/04; F21V 3/0472; F21V 3/049; F21V 3/023; F21V 17/002; F21V 17/005; F21V 17/16; F21V 19/0035; F21V 19/0045; F21V 15/01; F21V 15/011; F21V 7/04; F21V 7/045; F21V 7/046; F21V 29/505; F21S 4/00; F21S 4/001; F21S 8/083; Y10S 362/812; A47G 1/0622; G04B 19/21

USPC ..... 362/294, 307, 311.13, 352, 360, 361, 362/362, 363, 407, 408, 288, 237, 248, 362/345; 40/506, 540, 564, 575, 576, 40/606.12, 738

See application file for complete search history.

(56) References Cited

U.S. PATENT DOCUMENTS

| | | | | | |
|---|---|---|---|---|---|
| 986,590 | A | * | 3/1911 | Persons | 362/300 |
| 1,000,231 | A | * | 8/1911 | Bowles | 396/656 |
| 1,180,138 | A | * | 4/1916 | Giese | 40/553 |
| 1,592,595 | A | * | 7/1926 | Arendt | 40/564 |

(Continued)

OTHER PUBLICATIONS

The Crystal Reference Encyclopedia, "Refraction", 2005, Crystal Semantics Limited, 2 pages.*

*Primary Examiner* — Alan Cariaso

(74) *Attorney, Agent, or Firm* — Lowry Blixseth LLP; Scott M. Lowry

(57) ABSTRACT

An ornament with a backlit film image having a substrate with an at least partially transparent portion viewable therethrough when backlit. A first end cap and a second end cap are configured to receive and retain a portion of the substrate in a substantially closed loop shape such that the first and second end caps and the substrate support one another into a substantially upright position to define an enclosure. A light source is disposed within the enclosure and positioned to illuminate the backlit film image at least partially viewable through the transparent portion of the substrate.

33 Claims, 7 Drawing Sheets

(56) References Cited

U.S. PATENT DOCUMENTS

| | | | | | |
|---|---|---|---|---|---|
| 1,663,386 | A | * | 3/1928 | Rice | 40/564 |
| 2,339,385 | A | * | 1/1944 | Dupler | 362/363 |
| 3,109,252 | A | * | 11/1963 | Schellenberg | 40/554 |
| 3,587,185 | A | * | 6/1971 | Deal | 40/564 |
| 3,764,801 | A | * | 10/1973 | Mainieks | 362/352 |
| 4,196,535 | A | * | 4/1980 | Heimo | 40/738 |
| 4,290,096 | A | * | 9/1981 | Szpur | 362/223 |
| 4,953,067 | A | * | 8/1990 | Moore | 362/431 |
| 5,184,890 | A | * | 2/1993 | Chen et al. | 362/353 |
| 5,513,084 | A | * | 4/1996 | Simpson | 362/284 |
| 5,685,635 | A | * | 11/1997 | Barthelmess | 362/249.08 |
| 5,809,679 | A | * | 9/1998 | Arjmand | 40/564 |
| 5,911,501 | A | * | 6/1999 | Katz | 362/267 |
| 6,010,236 | A | * | 1/2000 | Lai | 362/396 |
| 6,282,825 | B1 | * | 9/2001 | Godfrey et al. | 40/611.01 |
| 6,572,247 | B2 | * | 6/2003 | Liu | 362/311.06 |
| 7,946,735 | B2 | * | 5/2011 | Chou et al. | 362/345 |
| 2011/0233593 | A1 | * | 9/2011 | Kawagoe et al. | 257/98 |

* cited by examiner

ORNAMENT WITH BACKLIT FILM IMAGE

BACKGROUND OF THE INVENTION

This invention relates generally to an ornament including backlit film bearing a custom image formed into a generally cylindrical shape and retained in the form of a hollow cylinder by circular upper and lower retainer caps. At least one of these retainer caps, such as the upper cap, has a small opening formed therein to receive a light source, such as a light mounted along an elongated strand of the type used for Christmas decorations.

Backlit film is generally known in the art for use in printing a custom image onto the film, and then backlighting the printed film to illuminate the custom image. Such backlit film is often used in the preparation of posters and the like of generally planar shape. Backlit film has recently become available for use in home printing applications, such as by use of an inkjet printer or the like for printing of a wide variety of home artwork, such as individual photographs of friends and relatives. Exemplary backlit film is commercially available in rolls of different sheet lengths suitable for use with wide format inkjet media from Eastman Kodak Company, Rochester, N.Y., under the brand name Kodak Premium Backlit Film, or from Hewlett-Packard Development Company of Houston, Tex., under the brand name HP Premium Vivid Color Backlit Film.

The present invention pertains to a relatively simple and easily constructed ornament having a three-dimensional shape, particularly such as a generally cylindrical shape, wherein backlit film bearing a custom image and formed into the desired size and shape is formed into a hollow cylinder and retained by upper and lower retainer caps, for selected assembly individually or in groups with an elongated light strand having multiple light sources. Each ornament is arranged with one of the light sources positioned therein to backlight the custom film image.

SUMMARY OF THE INVENTION

The ornament with a backlit film image disclosed herein includes a substrate having an at least partially transparent portion viewable therethrough when backlit. A first end cap and a second end cap are configured to receive and retain a portion of the substrate in a substantially closed loop shape such that the first and second end caps and the substrate form an ornament that maintains a substantially upright position defining an enclosure. In this respect, an adhesive may be disposed on a portion of the substrate for retaining overlapping portions of the substrate in the closed loop shape. A light source is disposed within the enclosure and positioned to illuminate the backlit film image at least partially viewable through the transparent portion of the substrate.

In a particularly preferred embodiment, the substrate includes a substantially rigid transparent substrate. Here, the backlit film image may be attached around the outside or tensioned to expand into an inner surface of the transparent substrate for viewing. A plug may be selectively attachable to the first end cap and include an insert for selectively retaining and hanging the light source within the enclosure. In this respect, it may be preferable to include a reflector coupled to the second end cap. A domed reflector is particularly preferred as it can be positioned to reflect light from the light source onto the backlit film image. Doing so provides additional illumination against the image itself instead of allowing the light to potentially escape or dissipate through the ends of the enclosure. The domed reflector may further include a vent to permit convection cooling throughout the enclosure. The vent is particularly useful when used in conjunction with an accompanying vent formed from a portion of the first end cap.

The first and second end caps preferably include a channel configured for slide-fit reception of the substrate. The channels may include a projection configured to selectively engage respective apertures formed in a portion of the substrate. The projections may lock into the apertures by snap-tight or press-fit engagement. The first end cap may further include an insert configured to receive and hang the light source within the enclosure. Such an insert may include an x-slit or a set of flaps formed from a portion of the first end cap. Like the first end cap, the plug may also include one or more vents.

In an alternative embodiment, the substrate may include a translucent pocket defined by a pair of generally overlying films for slidably receiving and supporting the backlit film image. In another alternative embodiment, the backlit film image may be formed from a portion of the substrate. Furthermore, the light source may be coupled to an elongated strand having additional lights coupled thereto, such as a set of Christmas tree lights.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
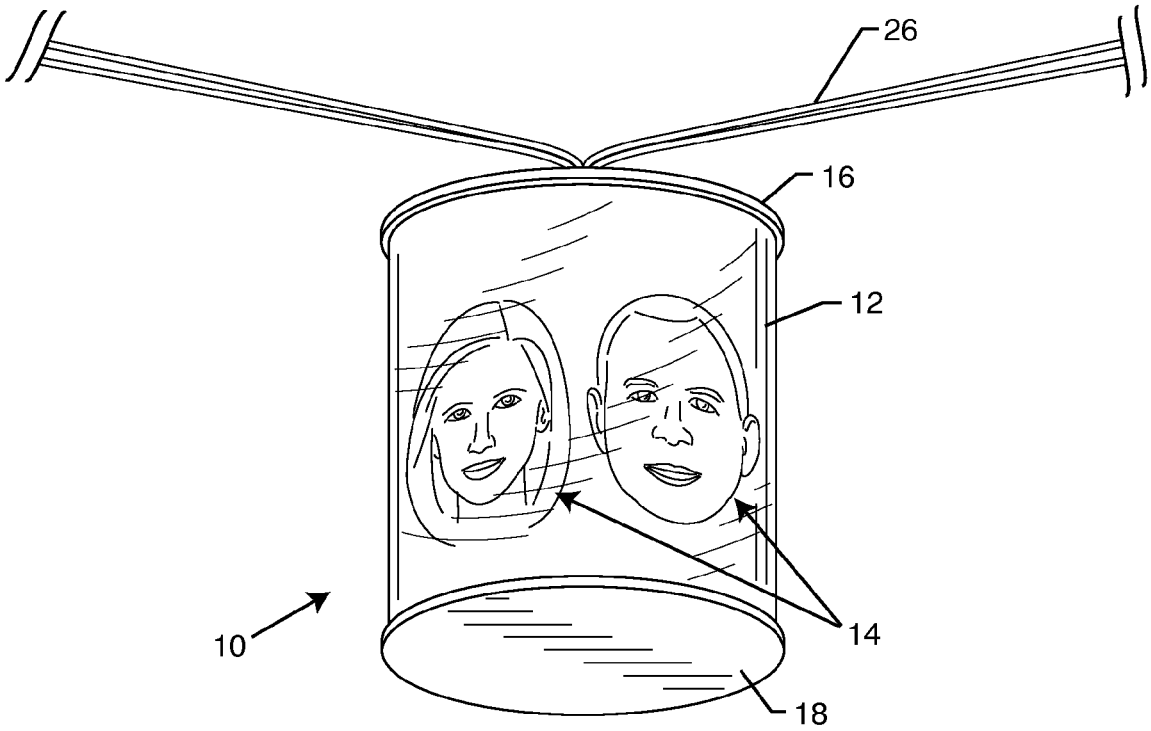
FIG. 1 is a fragmented perspective view of a backlit ornament constructed in accordance with the present disclosure.

The present invention relates to an ornament referred to generally in FIG. 1 by the reference numeral 10. The ornament comprises a sheet of backlit film 12 bearing a custom-printed image 14 and rolled into a generally cylindrical shape retained by a pair of generally circular upper and lower retainer caps 16 and 18. At least the upper retainer cap 16 has a small opening 20 (FIG. 2) formed therein for slide-fit reception of and engagement with the base 22 or the like of a light source 24 (FIG. 3), such as a small light mounted along the length of an elongated strand 26 of conductors carrying multiple light sources of a type used in a conventional strand of decorative Christmas or holiday lights or the like.

The sheet of backlit film 12 comprises a sheet of known backlit film material such as that commercially available in rolls of different sheet lengths suitable for use with wide format inkjet media from Eastman Kodak Company, Rochester, N.Y., under the brand name Kodak Premium Backlit Film, or from Hewlett-Packard Development Company of Houston, Tex., under the brand name HP Premium Vivid Color Backlit Film. Such backlit film is quickly and easily used to apply by printing the custom image 14 thereto, such as a photograph or portion thereof displaying the image of friends or family members, as shown in the illustrative drawings. Persons skilled in the art will recognize and appreciate, however, that alternative backlit film sheets in planar form, such as in 8.5×11 inch sheets, can be used in a standard home inkjet printer or the like.

After printing of the custom image 14 onto the backlit film sheet 12, the backlit film sheet 12 is cut into a desired length and width for subsequent rolling into a generally hollow cylindrical shape. In this regard, in accordance with one preferred form of the invention, the backlit film sheet 12 is trimmed to include the custom image 14, with an exemplary sheet length of at least about 5.5 inches and a selected height on the order of about 2-3 inches (as viewed in FIG. 2). When this trimmed backlit sheet 12 bearing the custom image 14 is rolled into a hollow cylindrical shape having a diametric size of about 1.75 inches, there is a slight overlap of the opposed ends of the sheet 12. A thin layer of a selected adhesive 28 (FIG. 2) can be applied to one of these overlapping ends for securing the backlit film sheet 12 in the cylindrical shape of the desired size. Persons skilled in the art will recognize, however, that alternative means may be used for securing the opposite ends of the backlit film sheet 12, and/or that the film sheet 12 can be rolled into a different cylindrical size. Persons skilled in the art will also recognize that the entire backlit film sheet 12 may be coated on the reverse or rear side with a suitable pressure sensitive adhesive, in lieu of the selected adhesive 28.

The cylindrical backlit film sheet 12, bearing the custom image 14, is then assembled quickly and easily with the pair of upper and lower retainer caps 16 and 18, respectively. As shown best in FIG. 2, both of these retainers caps 16, 18 include an annular rim 30 against which the associated upper or lower end of the cylindrical film sheet 12 fits snugly, in combination with an outwardly radiating upper or lower flange 32 that projects a short distance beyond the film sheet 12 assembled against the rim 30. Both caps 16, 18 are desirably constructed from a lightweight and economical plastic material. If desired, a small adhesive bead (not shown) can be applied to the rims 30, or alternately to the reverse side of the film sheet 12 along the top and bottom edges, for more permanently securing the film sheet 12 to the cap rims 30. As a further alternative, persons skilled in the art will appreciate that a shallow groove (not shown) may be included at the juncture of the rim 30 and flange 32 for assisting in support and retention of the backlit film sheet 12.

Figure 2:
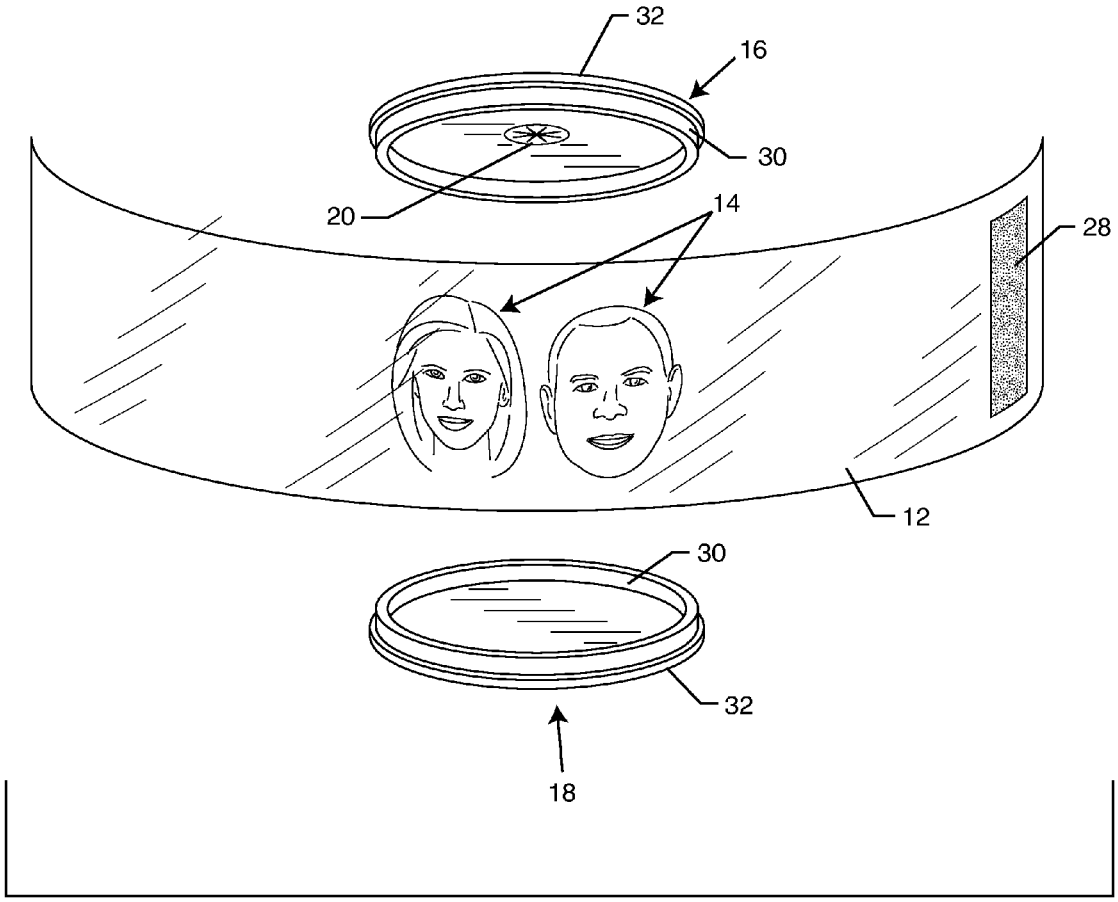
FIG. 2 is a perspective view showing a backlit film sheet bearing an image in exploded relation with upper and lower caps.
Figure 3:
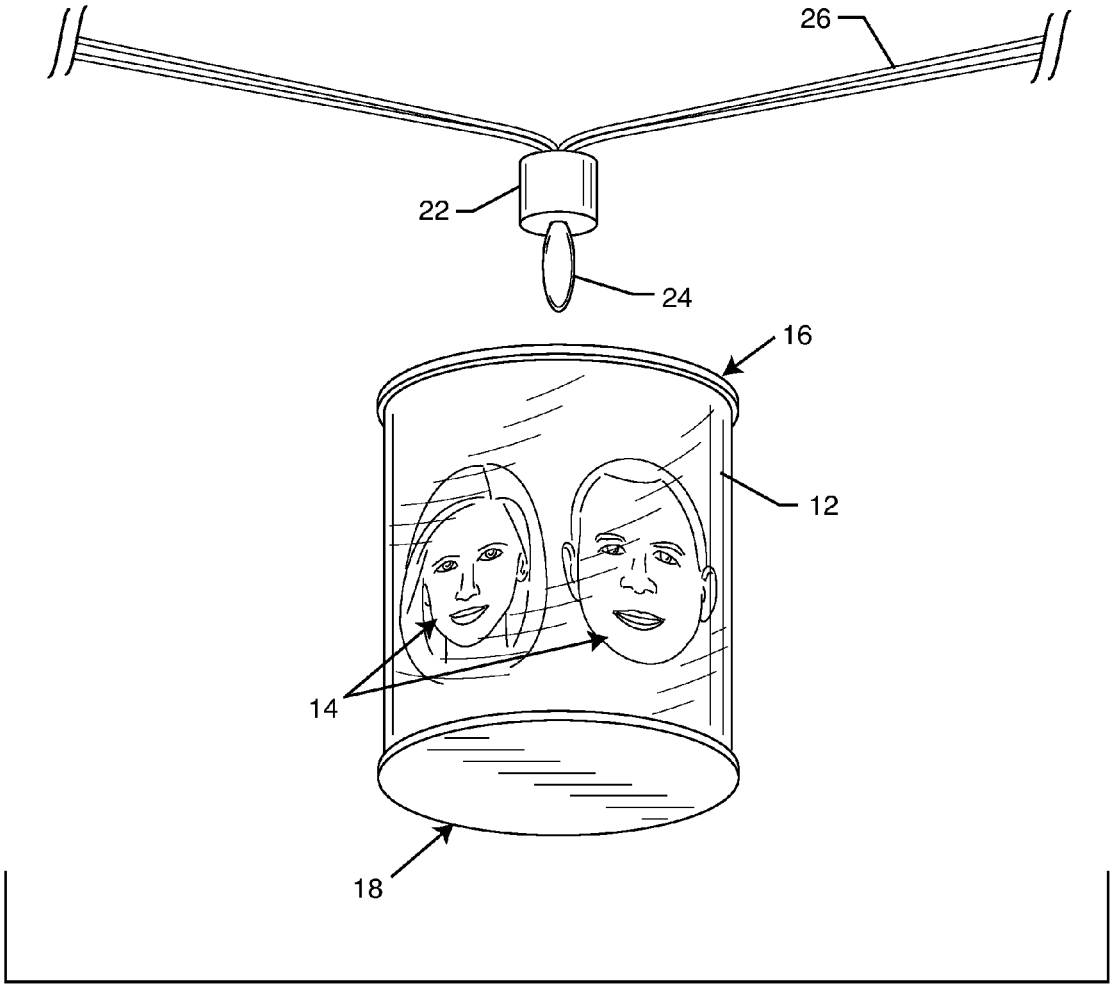
FIG. 3 is a perspective view showing the assembled ornament in exploded relation with an illuminating light source, such as a Christmas tree light strand.

At least one of the upper and lower retainer caps 16, 18, and preferably the upper cap 16, includes the small opening 20 for receiving and supporting the base 22 of one of light source 24. FIG. 2 shows the upper cap 16 having an X-slit formed centrally therein as the opening 20. Prior to receiving the light source 24, the X-slit 20 is substantially closed to prevent light leakage from the hollow ornament interior. But the X-slit 20 accommodates quick and easy press-fit reception of the light source 24 for friction-fit engagement of the light base 22 in a manner which securely supports and positions the associated light source 24 within the hollow ornament interior (FIGS. 1-3).

The light source 24 thus back-illuminates the custom image 14 on the now-cylindrical back-lit film sheet 12, resulting in a highly pleasing and different type of ornament visually displaying the custom image 14, such as the exemplary photograph of friends and/or family members, or other selected customized artwork. This ornament 10 can be used alone, preferably mounted at a selected location along a strand 26 of lights 24 in association with one of the lights 24 (FIGS. 1-3), or alternately, multiple ornaments 10 each having the same or a different custom image 14 printed thereon can be mounted along the strand 26 (FIG. 4) each in association with a respective one of the lights 24. In either case, the resultant ornament or ornaments 10 provide a unique and pleasing custom decorative effect that is especially suited for use as a holiday decoration such as Christmas and the like.

Figure 5:
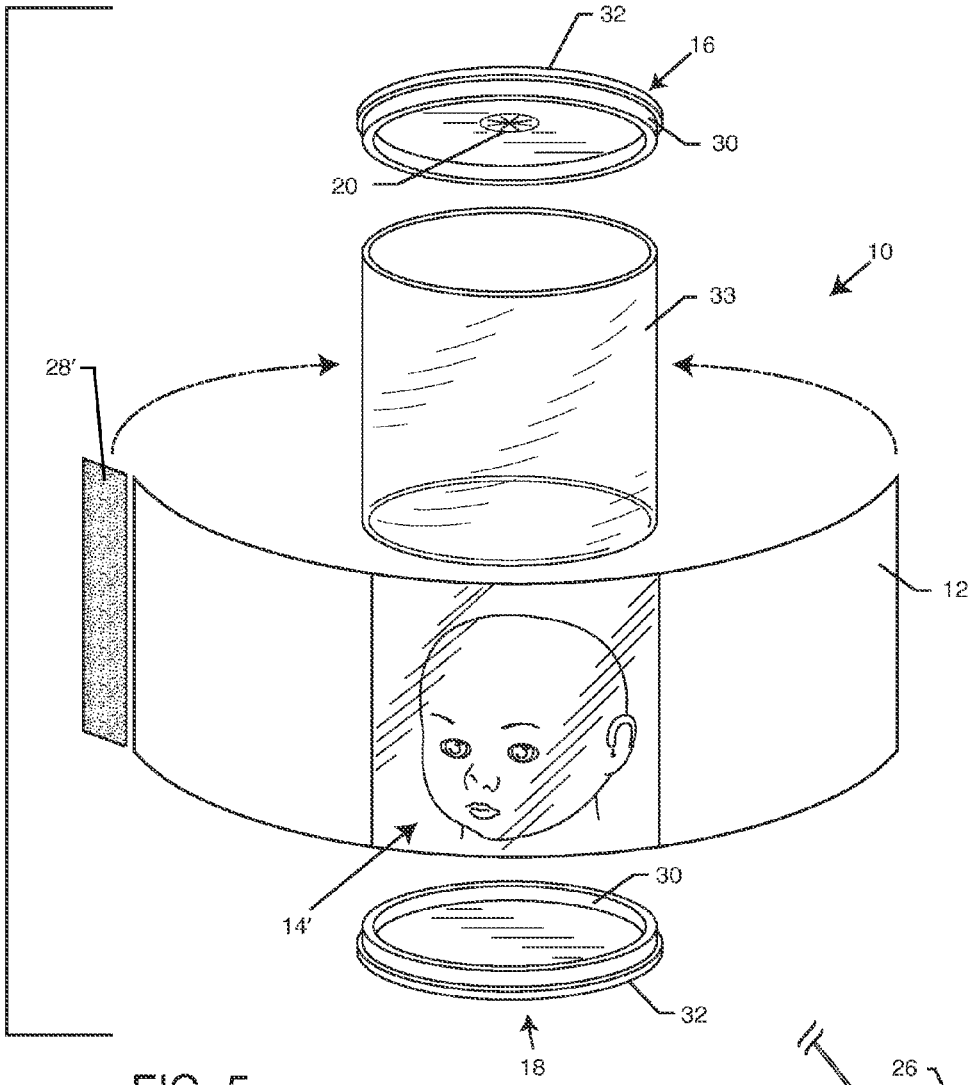
FIG. 5 is an exploded perspective view of an alternative ornament, including a transparent sleeve for supporting the backlit film.
Figure 6:
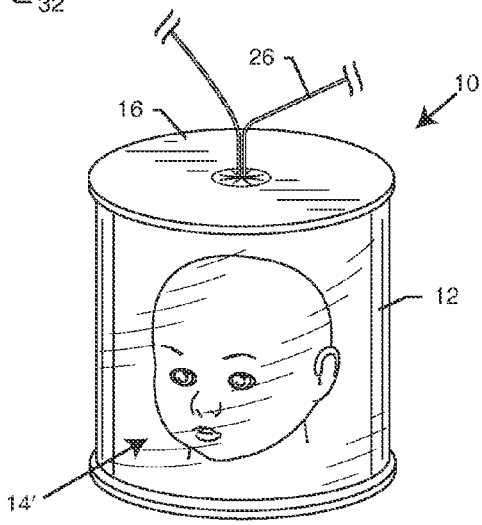
FIG. 6 is an assembled perspective view of the ornament of FIG. 5.

Additionally, FIGS. 5-6 illustrate another embodiment of the ornament 10, including a transparent sleeve 33 for use in supporting the backlit film 12 when connected to the upper retainer cap 16 and the lower retainer cap 18. The transparent sleeve 33 is generally formed from a somewhat rigid or hard plastic support layer or substrate configured to receive the backlit film 12 in a supportive upright position. As described above, the backlit film 12, such as the one shown in FIG. 5, is preferably cut to a height that is approximately the same height as the transparent sleeve 33. Furthermore, the backlit film 12 is preferably cut to a length that allows the film 12 to easily encompass the outer diameter of the transparent sleeve 33 in a manner that allows partial overlap so that the adhesive 28', such as clear plastic tape, a gel-like adhesive, or the like, can adhere adjoining sections of the backlit film 12 generally circumferentially around the exterior of the transparent sleeve 33. As such, the backlit film 12 containing an alternative image 14' easily wraps around and attaches to the outside of the transparent sleeve 33. The backlit image 12 may also be cut somewhat short such that portions of the film 12 do not overlap when placed around the exterior of the transparent sleeve 33. Here, it may be necessary to apply two strips of the adhesive 28' to hold each end of the backlit film 12 around the exterior of the transparent sleeve 33. In this embodiment, the backlit film 12 may be adhered to a portion of the transparent sleeve 33 instead of to itself. The backlit film 12 with the accompany image 14' may be attached to the transparent sleeve 33 before or after connection to the upper and lower end caps 16, 18, as described below.

The transparent sleeve 33 is connected to the upper and lower end caps 16, 18 in accordance with the embodiments disclosed herein. For example, with respect to FIGS. 5 and 6, the upper and lower retainer caps 16, 18 may attach by slide-fit or snap-fit engagement of the respective annular rims 30 within the interior of the transparent sleeve 33. In this embodiment, the annular rims 30 are retained within the interior of the transparent sleeve 33 by friction fit. As such, the retainer caps 16, 18 are selectively removable from the transparent sleeve 33 by unfitting or unsnapping the annular rims 30 out from within the transparent sleeve 33. Alternative embodiments may include other means for mechanically or adhesively attaching (permanently or temporarily) the retainer caps 16, 18 to the transparent sleeve 33. Once fully assembled as shown in FIG. 6, the aforementioned light source connected to the elongated strand 26 may be disposed within the interior of the transparent sleeve 33 to illuminate the image 14' on the backlit film 12.

Figure 7:
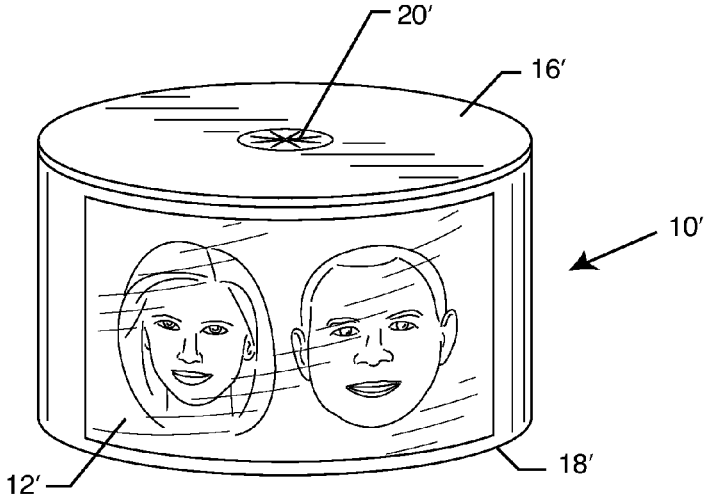
FIG. 7 is a perspective view showing one alternative preferred form of the ornament disclosed herein.
Figure 8:
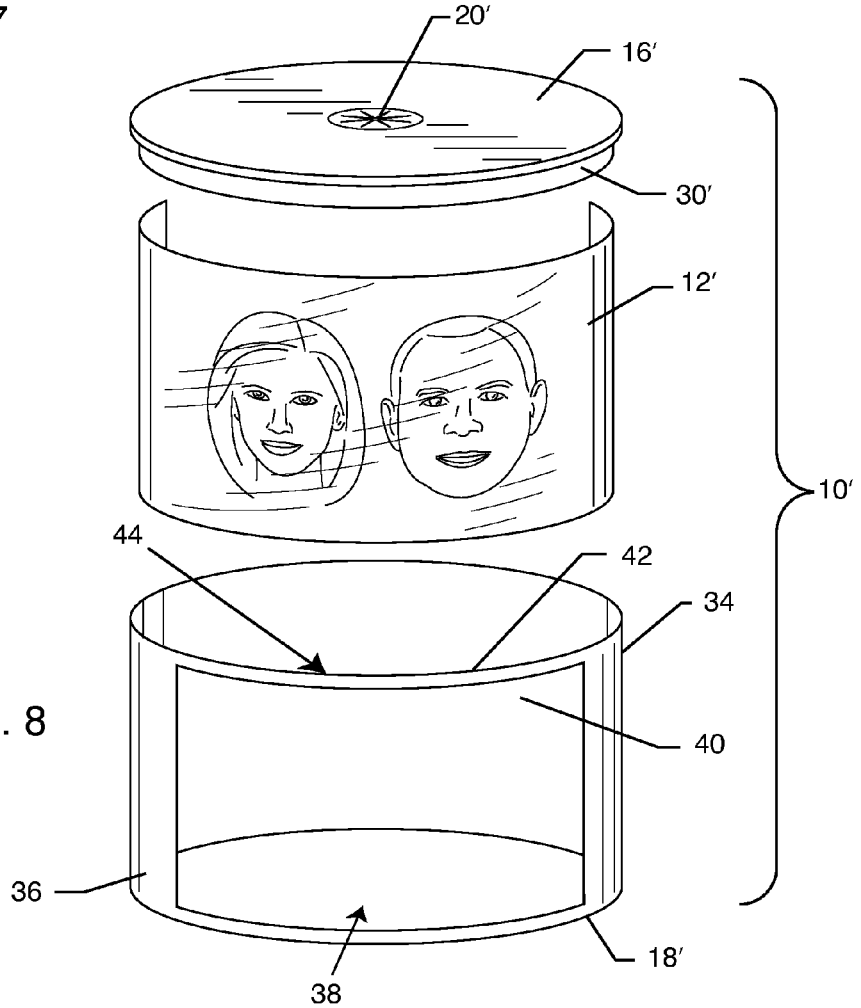
FIG. 8 is an exploded perspective view showing the alternative embodiment of FIG. 7.

An alternative preferred embodiment of the invention is shown in FIGS. 7-8. As shown, a modified ornament 10' is provided in a generally non-cylindrical shape such as the illustrative oval or elliptical configuration, with an upstanding closed loop wall segment 34 having a opaque or translucent region 36 lining a frontal portion or segment 38 defined by a pair of generally transparent overlying films 40, 42 forming an upwardly open pocket 44 for slidably receiving and supporting a piece of backlit film 12' having a selected image printed thereon. After printing the selected image, the backlit film 12' is trimmed to size as needed, and then slidably fitted into the upwardly open pocket 44 between the transparent films 40, 42, and an upper lid or cap 16' is fitted onto the underlying closed loop wall segment 12' as by slidably fitting a annular rim 30' into said wall segment 12'. If desired, an adhesive bead (not shown) can be used to essentially permanently secure these components together. A lower lid or cap 18' may also be fitted onto the lower end of the closed loop wall segment 12', as needed or desired.

Figure 4:
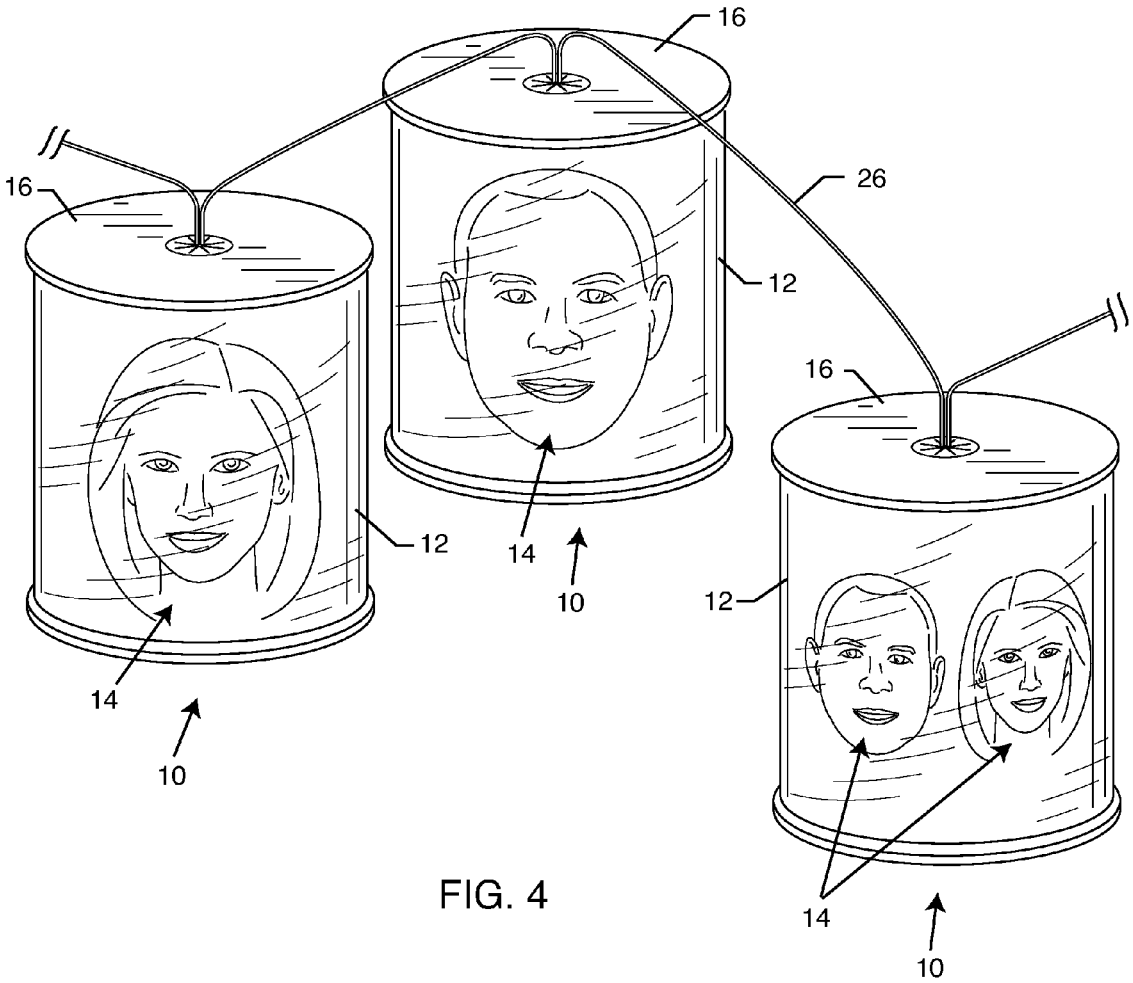
FIG. 4 is a perspective view showing multiple ornaments, each coupled to a light source on an elongated strand.

The upper lid or cap 16' includes a central opening 20', such as an X-slit as previously shown and described with respect to FIGS. 1-4, for receiving and retaining the light 24 (not shown in FIGS. 7-8) such as one of multiple holiday lights 24 on the strand 26 as viewed in FIG. 4. In use, the resultant ornament 10' receives and supports the backlit film 12' with the selected image thereon for suitable backlighting by means of the light 24, with the balance of the ornament 10' being constructed to be substantially opaque or translucent to provide a pleasing lighted ornament.

Figure 9:
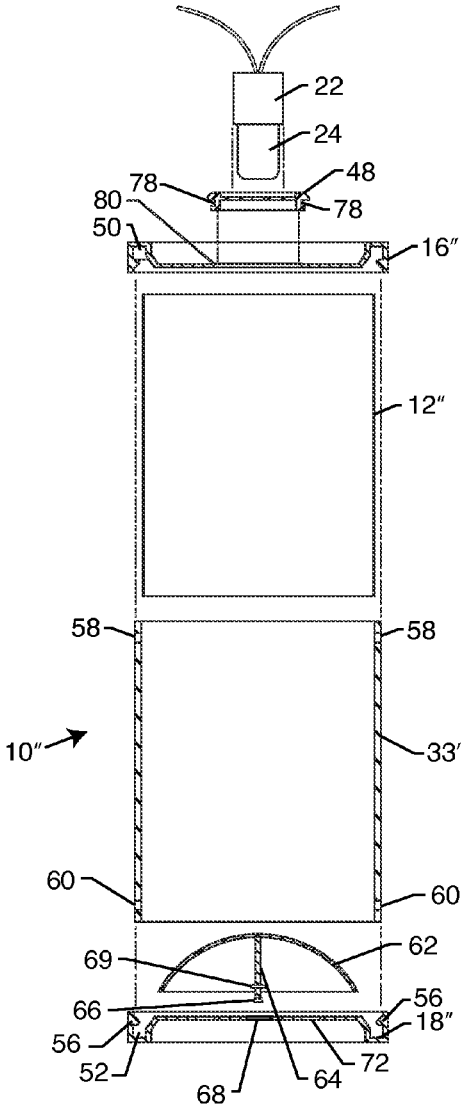
FIG. 9 is an exploded cross-sectional view of an alternative ornament with a backlit image, including a substantially rigid transparent sleeve that snaps into a pair of end caps.

Furthermore, FIGS. 9-13 illustrate an alternative embodiment of the ornament with a backlit film image as disclosed herein. More specifically, FIG. 9 illustrates an exploded cross-sectional view of an alternative ornament 10" including a modified upper retainer cap 16", a modified lower retainer cap 18", a modified transparent sleeve 33', a backlit film 12" and a plug 48 that slidably engages the upper retainer cap 16". In this embodiment, each of the upper and lower retainer caps 16", 18" include an upper and lower channel 50, 52, respectively configured for slide-fit reception of the transparent sleeve 33'. Additionally, the upper and lower retainer caps 16", 18" both include a series of upper and lower engagement projections 54, 56 configured to slidably engage one of a plurality of the upper or lower apertures 58, 60 formed out of the transparent sleeve 33'. Engagement of the upper and lower apertures 58, 60 with the upper and lower engagement projections 54, 56 is described in more detail below with respect to FIG. 11.

Figure 10:
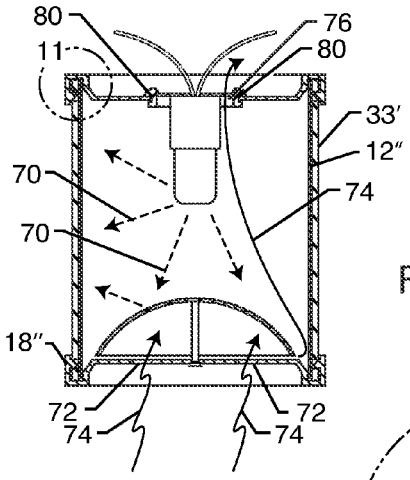
FIG. 10 is an assembled cross-sectional view of the alternative ornament of FIG. 9.

Furthermore, the ornament 10" shown in FIG. 9 includes a domed reflector 62 having an extension 64 with a flared end 66 configured to snap-fit or press-fit engage a retaining aperture 68 in the lower retainer cap 18". The diameter of the retaining aperture 68 is preferably approximately the same diameter as the outer diameter of the extension 64. In this respect, it may be preferable that the diameter of the retaining aperture 68 be somewhat slightly larger than the outer diameter of the extension 64 to facilitate slide-fit reception thereof. The flared end 66 is also preferably sized to slidably extend through the retaining aperture 68 yet wide enough to retain the domed reflector 62, as generally shown in FIG. 10, to the lower retainer cap 18". Once inserted, the domed reflector 62 remains affixed as the flared end 68 and a stop collar 69 sandwich a portion of the lower retainer cap 18" therebetween. Here, the domed reflector 62 is removably affixed to the lower retainer cap 18". Removal simply requires pulling the extension 64 and the flared end 66 back through the retaining aperture 68. Alternatively, the domed reflector 62 may be temporarily or permanently adhesively or mechanically attached (e.g., screwed or nailed) to the lower retainer cap 18".

Use of the domed reflector 62 is preferred as it reduces light fall-off through the bottom of the ornament 10" and serves as a baffle for ventilation holes. Additionally, it may also be desirable to couple a domed reflector to the upper retainer cap 18" (not shown). Of course, such an upper domed reflector would need to facilitate extension of the light source 24 therethrough. FIG. 10 more specifically illustrates a series of light waves 70 reflecting off the domed reflector 62 for redirection into the transparent sleeve 33' and the backlit film 12". Preferably, the interior surface of the domed reflector 62 is made from or coated with a reflective material. Additionally, FIG. 10 further illustrates a plurality of ventilation apertures 72 in the lower retainer cap 18" allowing a series of heat waves 74 to enter into the enclosure of the ornament 10", proceed around the domed reflector 62, and exit out through a set of plug or upper retainer cap ventilation apertures 76. The ventilation apertures 72, 76 facilitate airflow through the interior of the ornament 10" so that the ornament 10" is capable of convective cooling throughout the interior enclosure.

Figure 11:
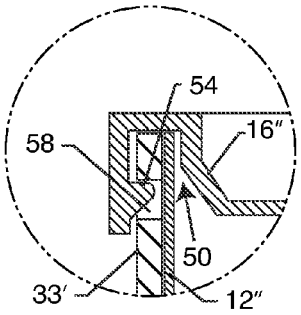
FIG. 11 is an enlarged cross-sectional view taken about the circle 11 in FIG. 10, further illustrating snap-fit reception of the end cap into the transparent sleeve.
Figure 12:
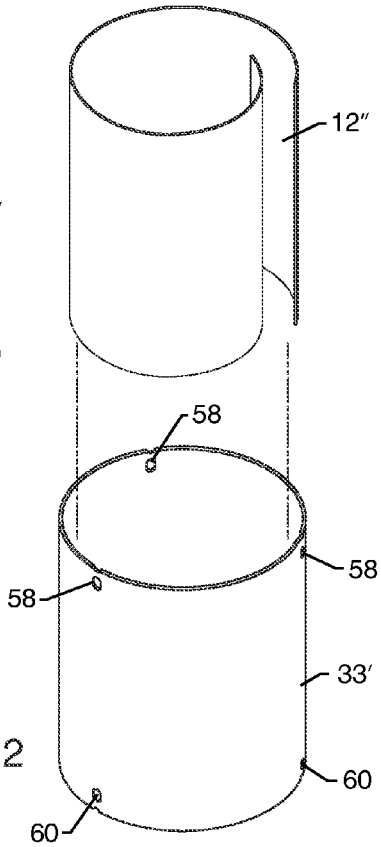
FIG. 12 is an partial exploded perspective view illustrating slide fit reception of the backlit film within the transparent sleeve.

FIG. 11 is an enlarged cross-sectional view illustrating engagement of the upper retainer cap 16" with the transparent sleeve 33'. More specifically, FIG. 11 illustrates engagement of the upper engagement projection 54 with the upper aperture 58 such that the upper retainer cap 16" removably engages the transparent sleeve 33'. The upper channel 50 may flex outwardly to accommodate insertion of the transparent sleeve 33' around the upper engagement projection 54. For example, the upper retainer cap 16" may be made from a substantially resilient and lightweight plastic material that permits slight outward flexing about the upper channel 50. This allows for enlargement of the upper channel 50 to facilitate insertion of the transparent sleeve 33' therein, such that the upper engagement projection 54 may slidably insert into and engage the upper aperture 58. Once engaged, the resilient plastic material comprising the upper retainer cap 16" retains its shape substantially as shown in FIG. 11. As shown in FIG. 12, the transparent sleeve 33' includes a plurality of upper apertures 58 circumferentially disposed about an upper portion thereof and configured for slide-fit or snap-fit engagement with a plurality of the upper engagement projections 54 disposed circumferentially around the interior of the upper channel 50 of the upper retainer cap 16". Accordingly, each upper engagement projection 54 engages a respective upper aperture 58 to ensure the upper retainer cap 16" remains substantially affixed to the transparent sleeve 33'.

Likewise, the transparent sleeve 33' includes the plurality of lower apertures 60 (FIG. 12) configured for slide-fit engagement with the plurality of corresponding lower engagement projections 56 in the lower retainer cap 18". The lower retainer cap 18" is also preferably manufactured from a substantially resilient yet flexible plastic material that allows for enlargement of the lower channel 52 upon desired insertion of the transparent sleeve 33' therein. In this respect, the lower channel 52 may flex outwardly to accommodate insertion of the transparent sleeve 33' beyond the lower engagement projections 56 for slide-fit or press-fit engagement with the corresponding lower apertures 60. Once engaged, the substantially resilient plastic material recovers back to its preferred shape as shown in FIGS. 9-10. Removal of either of the upper or lower engagement projections 54, 56 from the respective upper or lower apertures 58, 60 requires flexing the upper or lower retainer cap 16", 18" outwardly, thereby expanding the respective upper and/or lower channels 50, 52, to facilitate disengagement the projections 54, 56 from the apertures 58, 60.

In an alternative embodiment, the transparent sleeve 33' and/or the backlit film 12" may be permanently affixed to each of the upper retainer cap 16" and/or the lower retainer cap 18" by disposing an adhesive (not shown) in each of the respective upper and/or lower channels 50, 52. The adhesive bonds respective portions of the transparent sleeve 33' to the upper and lower retainer caps 16", 18". This embodiment may be more robust than other embodiments disclosed herein as it is not meant to be disassembled. Additionally, in another alternative embodiment, one or both of the retainer caps 16, 18 may screw into and out from a portion of the transparent sleeve 33' to be secured thereto or removed therefrom.

FIG. 12 is a partial exploded perspective view illustrating that the backlit film 12" slidably resides within the interior of the transparent out sleeve 33'. The backlit film 12", when assembled, is located to the interior of the transparent sleeve 33' in a manner best shown in FIG. 11. The backlit film 12" is configured to outwardly expand flush against the interior surface of the transparent sleeve 33'. In this respect, the transparent sleeve 33' acts as a supportive substrate that positions or carries the backlit film 12". The engagement projections 54, 56 are configured to wholly or partially extend into the apertures 58, 60 in the transparent sleeve 33', as best shown in FIG. 11, only so much as to allow for flush mounting of the backlit film 12" against the interior of the transparent sleeve 33'. Like the transparent sleeve 33', portions of the backlit film 12" may reside within respective upper and lower channels 50, 52 in the upper and lower retainer caps 16", 18". In a particularly preferred embodiment, the backlit film 12" may be sandwiched between a portion of the channel 50 and/or 52 and the interior of the transparent sleeve 33' upon press-fit engagement of the upper and lower engagement projections 54, 56 with the upper and lower apertures 58, 60 to prevent future movement of the backlit film 12" should the ornament 10" move after assembly. Of course, as described above, each of the upper and lower channels 50, 52 may include or be configured to receive an adhesive that glues the backlit film 12" and/or the transparent sleeve 33' to the upper and/or lower retainer caps 16", 18".

Figure 13:
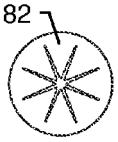
FIG. 13 is a top view of a plug selectively insertable into the top end cap.

Another feature of the ornament 10" shown with respect to FIGS. 9-10 and 11 is the plug 48. The plug 48 includes an engagement channel 78 that selectively engages a flange 80 formed from a portion of the upper retainer cap 16". The plug 48 may selectively snap into or be removed from the upper retainer cap 16", as needed. Preferably, the plug 48 disclosed herein includes a plurality of flexible insertion flaps 82, as shown in FIG. 13, capable of flexing to receive the aforementioned base 22 and the light source 24 by friction-fit reception. The insertion flaps 82 may operate in a manner similar to the aforementioned small opening/X-slit 20 described with respect to the embodiments above. Of course, a person of ordinary skill in the art will readily recognize that there may be many different ways of facilitating insertion, retention and/or connection of the light source 24 (and possible the corresponding base 22) into the interior of the transparent sleeve 33' to accomplish backlit lighting of the film 12". The removable aspect of the plug 48 allows the ornament 10" to be used with different lighting fixtures. For example, instead of slide-fit reception of the base 22 and the light source 24, the plug 48 may be made as part of a pre-formed combination light source and plug. Here, the plug/light source simply attach to the ornament 10" through snap-fit or press-fit engagement of the engagement channel 78 with the flange 80. This embodiment may be particularly preferred for use with the aforementioned elongated strand 26, such as for use in stringing multiple ornaments 10, 10', 10" in association with the Christmas tree strand as shown in FIG. 4.

Persons skilled in the art will recognize and appreciate that the closed loop shape of the ornament 10, 10', 10" can be provided in virtually any desired closed loop configuration, such as circular (FIGS. 1-6 and 9-13) or oval (FIGS. 7-8) as shown, or alternative closed loop shapes including but not limited to triangles, rectangles and other polygons, truncated cones, and the like.

Although several embodiments have been described in detail for purposes of illustration, various modifications may be made to each without departing from the scope and spirit of the invention. Accordingly, the invention is not to be limited, except as by the appended claims.

What is claimed is:

1. An ornament with a backlit film image, comprising:

a substrate having a substantially inner surface and an at least partially transparent portion viewable therethrough when backlit;

a curved backlit film image removably coupled with the substrate and having a top surface and a bottom surface;

a first end cap and a second end cap configured to receive and retain a portion of the substrate in a substantially closed loop shape, wherein the first and second end caps and the substrate are supported into a substantially upright position to define an enclosure;

a light source disposed within the enclosure and positioned to illuminate the backlit film image at least partially viewable through the transparent portion of the substrate; and an insert received in the first end cap for selectively retaining and hanging the light source within the enclosure, wherein the insert comprises an X-slit or a set of flaps formed from a portion of the first end cap.

2. The ornament of claim 1, wherein the substrate comprises a substantially rigid and cylindrical transparent substrate.

3. The ornament of claim 2, wherein the backlit film image is tensioned to expand into the inner surface of the transparent substrate.

4. The ornament of claim 2, wherein the backlit film image wraps around a portion of an exterior surface of the transparent substrate.

5. The ornament of claim 4, including an adhesive disposed on a portion of the backlit film image for retaining the backlit film image in the closed loop shape around the exterior surface of the transparent substrate.

6. The ornament of claim 1, including a plug selectively attachable to the first end cap, wherein the plug includes the insert for selectively retaining and hanging the light source within the enclosure.

7. The ornament of claim 1, including a reflector coupled to the second end cap.

8. The ornament of claim 7, wherein the reflector comprises a domed reflector positioned to reflect light from the light source onto the backlit film image.

9. The ornament of claim 7, wherein the second end cap includes a vent to permit convection cooling throughout the enclosure.

10. The ornament of claim 1, wherein the first and second end caps include a channel configured for slide-fit reception of the substrate.

11. The ornament of claim 10, wherein the channel includes a projection configured for selective engagement with an aperture in the substrate for locking engagement therewith.

12. The ornament of claim 1, wherein the substrate includes a translucent pocket defined by a pair of generally overlying films for slidably receiving and supporting the backlit film image.

13. The ornament of claim 1, wherein the backlit film image comprises a portion of the substrate.

14. The ornament of claim 1, wherein the light source is coupled to an elongated strand having additional lights coupled thereto.

15. The ornament of claim 1, including an adhesive disposed on a portion of the backlit film image for retaining overlapping portions thereof in the closed loop shape.

16. An ornament with a backlit film image, comprising:

a substantially transparent substrate having an inner surface and an at least partially transparent portion viewable therethrough when backlit;

a curved backlit film image having a top surface and a bottom surface, said backlit film image selectively removably coupled to the inner surface of the substrate;

a first end cap and a second end cap configured to receive and retain a portion of the substrate in a substantially closed loop shape, wherein the first and second end caps and the substrate are supported into a substantially upright position to define an enclosure;

a light source disposed within the enclosure and positioned to illuminate the backlit film image at least partially viewable through the transparent portion of the substrate; and an insert received in the first end cap for selectively retaining and hanging the light source within the enclosure, wherein the insert comprises an X-slit or a set of flaps formed from a portion of the first end cap.

17. The ornament of claim 16, wherein the backlit film image is tensioned to expand into the inner surface of the transparent substrate.

18. The ornament of claim 16, wherein the second end cap includes a vent to permit convection cooling throughout the enclosure and the first and second end caps include a channel configured for slide-fit reception of the substrate.

19. The ornament of claim 18, wherein the channels include a projection configured for selective respective engagement with an aperture in the substrate for locking engagement therewith and the substrate includes a translucent pocket defined by a pair of generally overlying films for slidably receiving and supporting the backlit film image.

20. The ornament of claim 16, wherein the light source is coupled to an elongated strand having additional lights coupled thereto.

21. The ornament of claim 16, including an adhesive disposed on a portion of the substrate for retaining overlapping portions thereof in the closed loop shape, wherein the backlit film image comprises a portion of the substrate.

22. An ornament with a backlit film image, comprising:

a substantially transparent substrate having an at least partially transparent portion viewable therethrough when backlit, wherein the backlit film image is tensioned to expand into an inner surface of the transparent substrate;

a first end cap and a second end cap having respective channels configured for slide-fit reception of the substrate in a substantially closed loop shape, wherein the first and second end caps and the substrate are supported into a substantially upright position to define an enclosure;

at least one projection coupled to each respective channel configured for selective engagement with a respective aperture in the substrate for press-fit engagement therewith;

a light source disposed within the enclosure and positioned to illuminate the backlit film image at least partially viewable through the transparent portion of the substrate;

a plug selectively attachable to the first end cap, wherein the plug includes an insert comprising an X-slit or a set of flaps formed from a portion of the first end cap for selectively retaining and hanging the light source within the enclosure; and a domed reflector coupled to the second end cap and positioned to reflect light from the light source onto the backlit film image, wherein the reflector includes a vent to permit convection cooling throughout the enclosure.

23. An ornament with a backlit film image, comprising:

a substrate having an at least partially transparent portion viewable therethrough when backlit;

a first end cap and a second end cap configured to receive and retain a portion of the substrate in a substantially closed loop shape, wherein the first and second end caps and the substrate are supported into a substantially upright position to define an enclosure;

a light source disposed within the enclosure and positioned to illuminate the backlit film image at least partially viewable through the transparent portion of the substrate; and a domed reflector coupled to the second end cap and positioned to reflect light from the light source onto the backlit film image, wherein the reflector includes a vent to permit convection cooling throughout the enclosure.

24. The ornament of claim 23, wherein the substrate comprises a substantially rigid transparent substrate.

25. The ornament of claim 24, wherein the backlit film image is tensioned to expand into an interior surface of the transparent substrate.

26. The ornament of claim 24, wherein the backlit film image wraps around a portion of an exterior surface of the transparent substrate and an adhesive retains the backlit film around the exterior surface of the transparent substrate.

27. The ornament of claim 23, wherein the first and second end caps include a channel having a projection configured for selective engagement with an aperture in the substrate for locking engagement therewith.

28. The ornament of claim 23, wherein the substrate includes a translucent pocket defined by a pair of generally overlying films for slidably receiving and supporting the backlit film image.

29. The ornament of claim 23, wherein the backlit film image comprises a portion of the substrate.

30. An ornament with a backlit film image, comprising:

a substantially rigid transparent substrate having an at least partially transparent portion viewable therethrough when backlit;

a first end cap and a second end cap configured to receive and retain a portion of the substrate in a substantially closed loop shape, wherein the first and second end caps and the substrate are supported into a substantially upright position to define an enclosure;

a light source disposed within the enclosure and positioned to illuminate the backlit film image at least partially viewable through the transparent portion of the substrate;

a plug selectively attachable to the first end cap, wherein the plug includes an insert for selectively retaining and hanging the light source within the enclosure; and a domed reflector coupled to the second end cap and positioned to reflect light from the light source onto the backlit film image, wherein the reflector includes a vent to permit convection cooling throughout the enclosure.

31. The ornament of claim 30, wherein the backlit film image is tensioned to expand into an inner surface of the transparent substrate and the first and second end caps include a channel configured for slide-fit reception of the substrate.

32. The ornament of claim 31, wherein the channels include a projection configured for selective respective engagement with an aperture in the substrate for locking engagement therewith and the substrate includes a translucent pocket defined by a pair of generally overlying films for slidably receiving and supporting the backlit film image.

33. The ornament of claim 30, including an adhesive disposed on a portion of the substrate for retaining overlapping portions thereof in the closed loop shape, wherein the backlit film image comprises a portion of the substrate and the light source is coupled to an elongated strand having additional lights coupled thereto.

* * * * *